US006872121B2

(12) United States Patent
Wiesner et al.

(10) Patent No.: US 6,872,121 B2
(45) Date of Patent: Mar. 29, 2005

(54) ELECTRICAL HAND TOOL DEVICE

(75) Inventors: Bernd Wiesner, Bad Urach (DE); Stefan Schwarz, Nuertingen (DE); Reinhard Plietsch, Brechen (DE); Marco Gaertner, Sinntal (DE); Patrick Neika, Hochwang (DE)

(73) Assignee: Metabowerke GmbH, Nürtingen (DE)

( * ) Notice: Subject to any disclaimer, the term of this patent is extended or adjusted under 35 U.S.C. 154(b) by 0 days.

(21) Appl. No.: 10/630,766

(22) Filed: Jul. 31, 2003

(65) Prior Publication Data

US 2004/0108120 A1 Jun. 10, 2004

(30) Foreign Application Priority Data

Aug. 23, 2002 (DE) ..... 102 38 710

(51) Int. Cl.[7] ..... B24B 1/00

(52) U.S. Cl. ..... 451/5; 451/358; 451/359; 340/5.6

(58) Field of Search ..... 451/5, 358–359; 340/5.55, 5.6, 5.61, 426.13, 5.64

(56) References Cited

U.S. PATENT DOCUMENTS 5,801,614 A * 9/1998 Kokubu ..... 340/425.5
5,873,276 A * 2/1999 Dawson et al. ..... 70/277
6,091,340 A * 7/2000 Lee et al. ..... 340/5.6
6,130,621 A * 10/2000 Weiss ..... 340/5.28
6,374,649 B1 * 4/2002 Holcomb et al. ..... 70/78
6,409,064 B1 * 6/2002 Bayley ..... 224/404
6,664,888 B1 * 12/2003 Bishop ..... 340/426.11
6,677,851 B1 * 1/2004 Losey ..... 340/5.62

FOREIGN PATENT DOCUMENTS

| | | |
|---|---|---|
| DE | 38 17 621 | 11/1989 |
| DE | 44 29 206 | 3/1996 |
| DE | 100 29 132 | 1/2002 |
| DE | 100 29 138 | 1/2002 |

* cited by examiner

*Primary Examiner*—George Nguyen
(74) *Attorney, Agent, or Firm*—Paul Vincent

(57) ABSTRACT

An electrical hand tool device (2) comprises a control electronics (8) and a transmitter and receiver (10) which is responsive in a wireless and contact-free fashion, and with a storage medium (12) in which an authorization code is stored, wherein an operation locking state and an operation release state can be differentiated, and with an external transmitter and receiver means (16) which is accommodated in a separate portable device (4), wherein communication with the transmitter and receiver means (10) of the electrical hand tool device can be produced in a defined fashion through actuation of the external transmitter and receiver means (16) to change the operation state, and communication is provided only to change the operation state and optionally to change the authorization code.

18 Claims, 2 Drawing Sheets

ELECTRICAL HAND TOOL DEVICE

This application claims Paris Convention priority of DE 102 38 710.9 filed Aug. 23, 2002 the complete disclosure of which is hereby incorporated by reference.

BACKGROUND OF THE INVENTION

The invention concerns an electrical hand tool device comprising a control electronics and a transmitting/receiving means which is responsive in a wireless and contact-free fashion, and a storage means in which an authorization code is stored, wherein an operation locking state and an operation release state can be differentiated, and with an external transmitting/receiving means which is disposed in a separate portable device. The above-mentioned differentiation between an operation locking state and an operation release state prevents unauthorized use by putting the device into a locking state in which the electrical hand tool device can no longer be operated. The electrical hand tool device is thereby protected against theft, since there is little to be gained thereby.

DE 100 29 138 A1 discloses an electrical hand tool device of this type. This device is designed such that its control electronics always tries to assume an operation locking state in which the device cannot be operated. If a user wants to operate the device, he/she requires an external transmitting/receiving means which may comprise a transponder. The internal transmitting/receiving means of the device tries to communicate discontinuously with such an external transmitting/receiving means. The control electronics switches the device into the operation release state only when the user has such a transmitting/receiving means, and, in response to the request signal, a correspondingly encoded response signal is transmitted which is received by the internal transmitting/receiving means of the device. Subsequently, the internal transmitting/receiving means communicates repeatedly, however, discontinuously, with the external transmitting/receiving means and the electrical hand tool device remains operative only for the duration of this communication and verification that the user has authorization. I.e. a permanent, however, discontinuous communication operation is required to maintain the operativeness of the device.

A further electrical hand tool device of a different type comprising a theft protection means is described in DE 100 29 132 A1. This electrical hand tool device comprises a telecommunication receiver, i.e. merely a receiving means which cooperates with control electronics of the hand tool device. If it is removed without authorization, the authorized user can activate an operation locking state through transmission of an operation locking signal via the telecommunication network to the telecommunication receiver of the hand tool device and the control electronics. Only the authorized user knows the telecommunication number required therefor. The telecommunication receiver of the electrical hand tool device causes difficulties and substantial expense. Moreover, a telecommunication connection is required to be able to address the device. In addition, transmission of information to the external telecommunication transmitter is not possible.

DE 44 29 206 C2 discloses an electrical hand tool device which automatically switches into an operation locking state when the electrical power is interrupted, i.e. when the battery is removed or the mains plug is removed or after a predetermined time interval. The device switches into the operation release state only upon receipt of a corresponding code signal. Permanent locking or release of the device is not possible.

It is the underlying purpose of the present invention to improve an electrical hand tool device of this type to prevent theft of the device in a simple but nevertheless effective fashion.

SUMMARY OF THE INVENTION

In accordance with the invention, this object is achieved for an electrical hand tool device of this type in that communication with the transmitting/receiving means of the electrical hand tool device can be produced in a defined fashion through actuation of the external transmitting/receiving means to change the operation state, and communication is provided only to change the operation state and optionally to change the authorization code.

The invention therefore proposes inclusion of actual transmitting/receiving means in both the hand tool device as well as in the external actuating device to permit transmission of signals with substantial information content, i.e. not merely auxiliary signals, as e.g. is the case for a telecommunication receiver for use in locating that receiver. The communication only takes place when the operation state is to be changed, when a locked device is to be permanently released for operation or when a device which is released for operation is to be permanently locked. In this fashion, the communication can be reduced to a minimum which is particularly advantageous with regard to the energy source (battery) of the external transmitting/receiving means. The susceptibility to disturbances is also reduced. Moreover, communication is normally carried out when the electrical hand tool device is not in operation, i.e. shortly before or shortly after the start of operation so that tool operation does not impair the switching process.

The two-way information transmission can also be used—as indicated above—for changing authorization codes or other data in the storage means of the electrical hand tool device.

The communication between the transmitting/receiving means takes place directly via radio connection or infrared interfaces. The external device with the external transmitting/receiving means is therefore in the direct vicinity of the electrical hand tool device i.e. within reach of the radio or infrared connection necessary for the communication.

Moreover, in one preferred advantageous embodiment of the electrical hand tool device, a signal which characterizes the operation state can be transmitted from the internal transmitting/receiving means to the external transmitting/receiving means and can be displayed there by a display means. This signal could be produced e.g. on request by the external transmitting/receiving means or, in a particularly preferred fashion, automatically subsequent to a successfully performed operation state change, i.e. without special request. The display means of the external transmitting/receiving means may then announce the information in a visual and/or acoustical manner.

In an advantageous further development of the invention writing into the storage means of the electrical hand tool device is possible and the authorization code stored therein can be changed through transmission of a required control command to the transmitting/receiving means of the electrical hand tool device thereby switching the control electronics and the storage means into a programming mode. The newly stored authorization code is then transmitted to the internal transmitting/receiving means of the device, preferably via digitised code signals.

The switching into the programming mode could be carried out e.g. via a communication means provided by the dealer or manufacturer. The transmission/receiving means may also have an input means for the authorization code, with the external transmitting/receiving means transmitting the newly entered authorization code to the electrical hand tool device. The input means may comprise mechanical input elements i.e. in the form of rotatable rollers. In a further embodiment of the invention, the input means or its input elements are covered by a lid disposed on the housing of the external transmitting/receiving means which can be pivoted or flipped open to enter a new authorization code.

It is also convenient for the user when the housing of the external transmitting/receiving means is provided with two actuating elements, in particular actuating buttons for transmitting the locking signal or the release signal. Simultaneous actuation of both elements may be interpreted as triggering the control command to set the hand tool device into the programming mode.

The invention also concerns a method for operating or locking an electrical hand tool device comprising the features of claim 10.

Further features, details and advantages of the invention can be extracted from the following claims, the drawing and following description of the inventive electrical hand tool device.

DESCRIPTION OF THE PREFERRED EMBODIMENT

Figure 1:
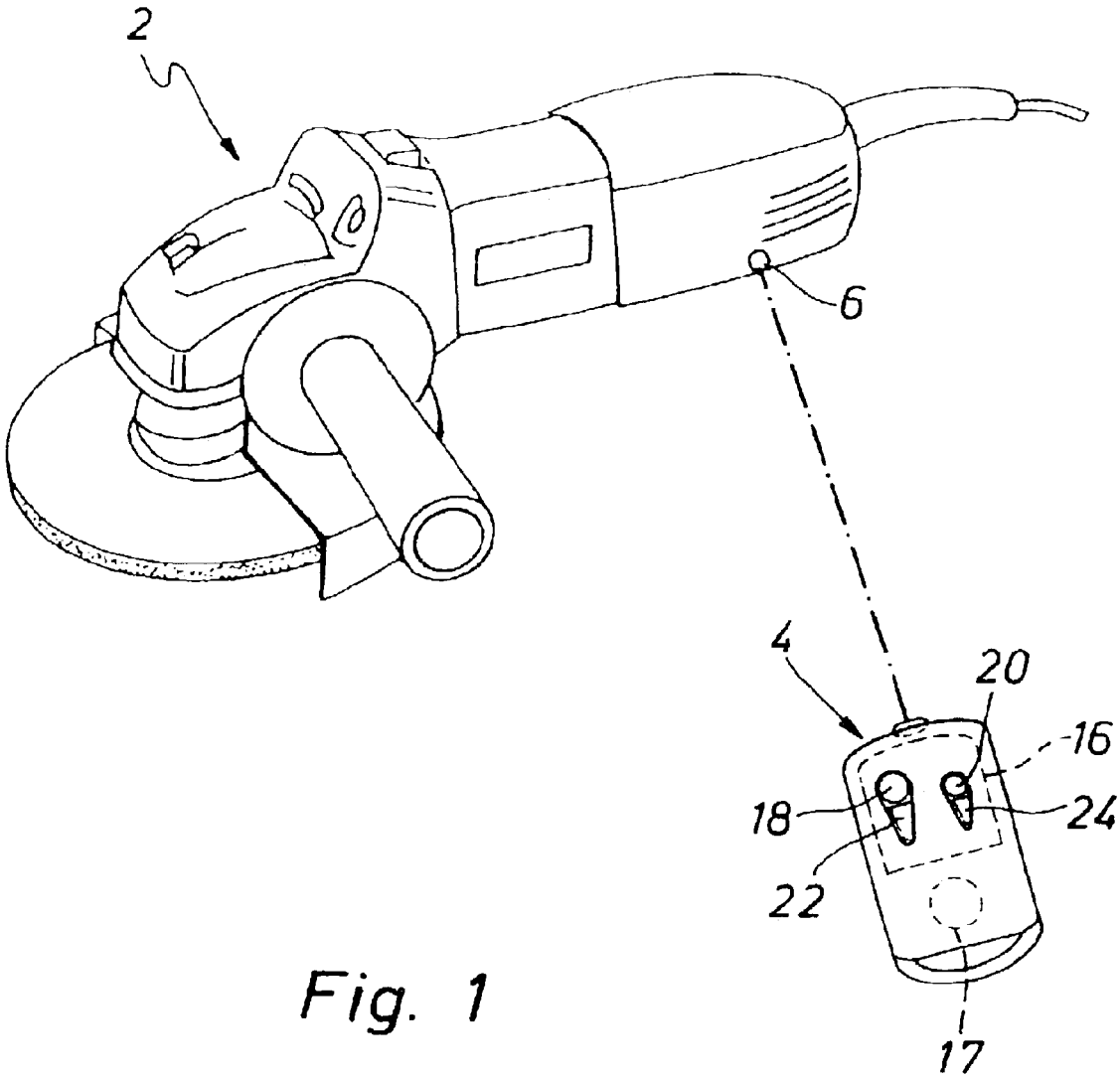
FIG. 1 shows an inventive electrical hand tool device.
Figure 2:
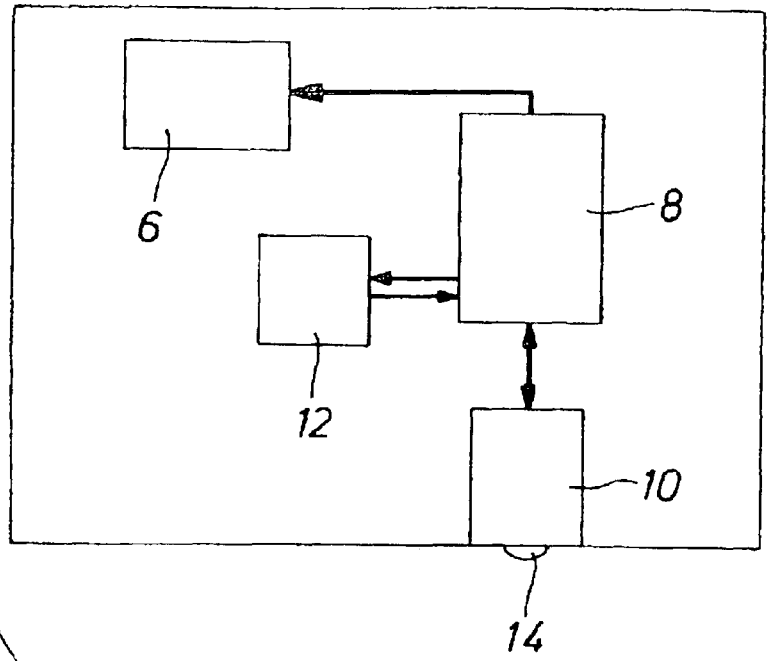
FIG. 2 shows the control components of the electrical hand tool device and an external control device.

FIG. 1 shows an electrical hand tool device 2 and an external auxiliary or control device 4 for changing the operation state of the electrical hand tool device 2 between an operation locking state and an operation release state. Towards this end, the electrical hand tool device 2 has a processor-controlled control electronics 8 acting on the motor control 6, a transmitting/receiving means 10, and a storage means 12 in which an authorization code is stored. The internal transmitting/receiving means 10 of the device communicates in a wireless and contact-free fashion, preferably via an infrared interface 14. The control electronics 8 is designed to place the electrical hand tool device 2 into a permanent operation locking state or an operation release state depending on the signal received from the transmitting/receiving means 8.

The external device 4 comprises a transmitting/receiving means 16 which is supplied with electric voltage from a round battery cell 17, and a control switch 18 for the transmitting/receiving means 16. An authorization code is stored in the external device 4 at 19, which can be changed in a manner described in detail below. This authorization code can be transmitted in digitized form during communication with the transmitting/receiving means 10 of the hand tool 2, and should the code correspond to the authorization code stored in the storage means 12 of the hand tool device 2, the control signal "locking" or "release" can be transmitted to the hand tool device 2 or its control electronics 8 and be appropriately processed and implemented.

Each electrical hand tool device 2 therefore has an external control device 4 having the same authorization code, or there may be several control devices 4, e.g. within an assembly line team, which can be used for permanent locking or permanent release of the hand tool device.

The external transmitting/receiving means 16 communicates with the transmitting/receiving means 10 of the tool device 2 for defined locking or release thereof. When the transmitted locking or release signal has been detected and the operation state has been changed, the transmitting/receiving means 10 of the tool device transmits a signal to the external transmitting/receiving means 16 which verifies successful change and which indicates the new operation state. This signal is subsequently evaluated and the operation state is visually and/or acoustically displayed. The external device 4 can comprise a miniature audio device and/or light diodes 18, 20 which are preferably colored, in particular red or green. When the tool device has been released for operation, the miniature audio device could subsequently produce a short single-component signal and when the device has been locked, a short double-component signal. Instead or additionally, an optical signal, e.g. a flashing green or red light diode could be used to signal the user that the device has been successfully locked or released.

It is particularly convenient for the user when the external device 4 has two mechanical actuating elements in the form of buttons 22, 24, which are pressed once for emitting the locking signal and the release signal, respectively.

Figure 3:
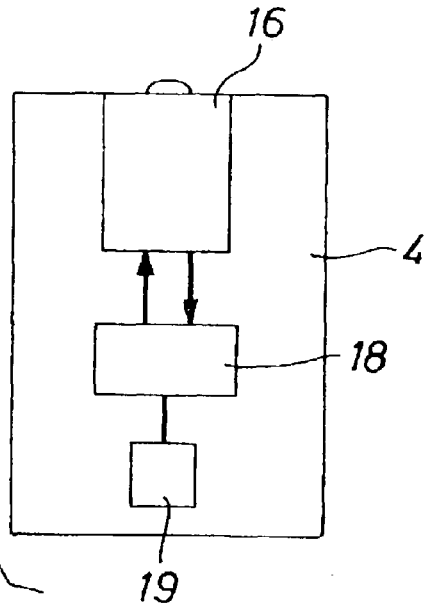
FIG. 3 shows external device 4 with input elements 28.
Figure 3:
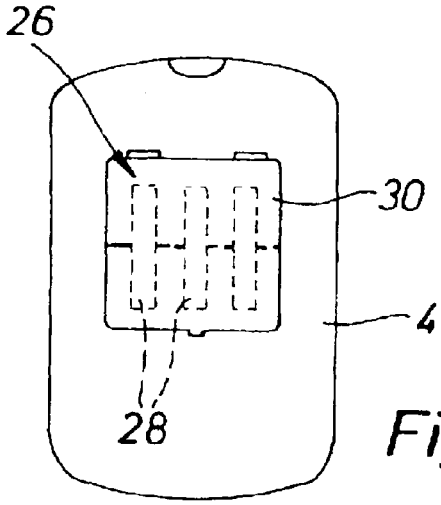

In accordance with FIG. 3, an input means 26 could be provided for entering the authorization code. Towards this end, the external device 4 could comprise several input elements 28, e.g. in the form of rotatable rollers which can be adjusted by the user to different positions, e.g. using a screw driver or another pointed object, similar to a combination lock. Should there be three rollers each with ten different positions, $10^3$ different lock combinations can be selected. The input means 26 in the present case is covered by a pivotable lid 30.

The manufacturer delivers the electrical hand tool device e.g. in the operable state, i.e. in the operation release state, and its control electronics and storage means are in the programming mode. The user can then enter his/her individual authorization code using the external device 4. Simultaneous pressing of the two buttons 22, 24 and holding for some seconds transmits a working signal to the electrical hand tool device 2 which transmits the authorization code set in the device 4 to the transmitting/receiving means 10 of the hand tool device which is then stored in the storage means 2 thereof. Pressing of one of the buttons 22, 24 permanently stores this new authorization code, after which the programming mode is terminated. A confirmation signal is then transmitted to the external transmitting/receiving means 16 and a long signal tone can be produced or appropriate optical signals can be emitted and the authorization code of the external device 4 stored in the hand tool device as the authorized locking code.

To change the stored authorization code, the programming mode can be restarted by simultaneously pressing the buttons 22, 24. This is only possible when the authorization codes of the external device 4 used thereby and that of the hand tool device 2 correspond. If they do not correspond, change to the programming mode is not permitted.

We claim:

1. An electrical hand tool device for locking and releasing an operational state of an electrical hand tool, the device comprising:

a first transmitter and receiver means disposed on the hand tool;

a storage means disposed on the hand tool for storage of an authorization code;

a control electronics disposed on the hand tool in electrical communication with said storage means and said first transmitter and receiver means; and a second transmitter and receiver means which is remote from the hand tool and accommodated in a separate, portable device, wherein actuation of said second transmitter and receiver means produces wireless communication with the first transmitter and receiver means in a contact-free fashion when the operational state of the hand tool is to be changed, wherein said communication changes said authorization code.

2. The electrical hand tool device of claim 1, wherein a signal which characterizes the operational state can be transmitted from the first transmitter and receiver means to the second transmitter and receiver means, wherein said separate, portable device comprises indication means for indicating the operational state.

3. The electrical hand tool device of claim 2, wherein said signal which characterizes the operational state can be automatically transmitted subsequent to a successful operation state change.

4. The electrical hand tool device of claim 2, wherein said indication means is at least one of visual and acoustical.

5. The electrical hand tool device of claim 1, wherein said storage means can be written into and said authorization code stored therein can be changed when a required control command is transmitted to said first transmitter and receiver means of the electrical hand tool device, thereby switching said control electronics and said storage means into a programming mode.

6. The electrical hand tool device of claim 1, wherein said second transmitter and receiver means comprises an input means for said authorization code with which said second transmitter and receiver means addresses the electrical tool device.

7. The electrical hand tool device of claim 6, wherein said input means comprises mechanical input elements which are preferably disposed such that they can be rotated.

8. The electrical hand tool device of claim 6, wherein said separable, portable device comprises a pivoting or flipping lid for covering said input means.

9. The electrical hand tool device of claim 1, wherein said separable, portable device comprises two actuating buttons for transmitting the locking signal and the release signal, respectively.

10. A method for operating or locking an electrical hand tool using an electrical hand tool device having a control electronics and a first transmitter and receiver means which is responsive in a wireless and contact-free fashion, and with a storage means in which an authorization code is stored, wherein an operation locking state and an operation release state can be differentiated, and with a second, external transmitter and receiver means which is accommodated in a separate, portable device, the method comprising the steps of:

a) transmitting first radio or infrared signals from the second transmitter and receiver means to the first transmitter and receiver means, said first signals consisting essentially of one of change of operational state information and change of authorization code information; and b) transmitting, following a change in operational state, second radio or infrared signals from the first transmitter and receiver means to the second transmitter and receiver means to announce said change in operational state to a user.

11. An electrical hand tool device for locking and releasing an operational state of an electrical hand tool, the device comprising:

a first transmitter and receiver means disposed on the hand tool;

a storage means disposed on the hand tool for storage of an authorization code;

a control electronics disposed on the hand tool in electrical communication with said storage means and said first transmitter and receiver means; and a second transmitter and receiver means which is remote from the hand tool and accommodated in a separate, portable device, wherein actuation of said second transmitter and receiver means produces wireless communication with the first transmitter and receiver means in a contact-free fashion when the operational state of the hand tool is to be changed, wherein said communication changes the operational state and a signal which characterizes the operational state can be transmitted from the first transmitter and receiver means to the second transmitter and receiver means, wherein said separate, portable device comprises indication means for indicating the operational state.

12. The electrical hand tool device of claim 11, wherein said signal which characterizes the operational state can be automatically transmitted subsequent to a successful operation state change.

13. The electrical hand tool device of claim 11, wherein said indication means is at least one of visual and acoustical.

14. The electrical hand tool device of claim 11, wherein said storage means can be written into and said authorization code stored therein can be changed when a required control command is transmitted to said first transmitter and receiver means of the electrical hand tool device, thereby switching said control electronics and said storage means into a programming mode.

15. The electrical hand tool device of claim 11, wherein said second transmitter and receiver means comprises an input means for said authorization code with which said second transmitter and receiver means addresses the electrical tool device.

16. The electrical hand tool device of claim 15, wherein said input means comprises mechanical input elements which are preferably disposed such that they can be rotated.

17. The electrical hand tool device of claim 15, wherein said separable, portable device comprises a pivoting or flipping lid for covering said input means.

18. The electrical hand tool device of claim 11, wherein said separable, portable device comprises two actuating buttons for transmitting the locking signal and the release signal, respectively.

* * * * *